US011732566B2

(12) United States Patent
Al-Nakhli et al.

(10) Patent No.: US 11,732,566 B2
(45) Date of Patent: Aug. 22, 2023

(54) SLICKWATER HYDRAULIC FRACTURING WITH EXOTHERMIC REACTANTS

(71) Applicant: Saudi Arabian Oil Company, Dhahran (SA)

(72) Inventors: Ayman Al-Nakhli, Dhahran (SA); Jose Rueda, Dhahran (SA); Mohammed Ahmed Alsayed, Dhahran (SA); Karim Mechkak, Dhahran (SA); Almaz Sadykov, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 204 days.

(21) Appl. No.: 17/532,840

(22) Filed: Nov. 22, 2021

(65) Prior Publication Data

US 2023/0160291 A1 May 25, 2023

(51) Int. Cl.
*E21B 43/27* (2006.01)
*E21B 37/06* (2006.01)
*E21B 43/267* (2006.01)

(52) U.S. Cl.
CPC ..... *E21B 43/27* (2020.05); *E21B 37/06* (2013.01); *E21B 43/267* (2013.01)

(58) Field of Classification Search
CPC ..... E21B 43/27; E21B 37/06; E21B 43/267
See application file for complete search history.

(56) References Cited

U.S. PATENT DOCUMENTS

| | | | | |
|---|---|---|---|---|
| 4,482,016 | A * | 11/1984 | Richardson | C09K 8/72 166/309 |
| 9,228,424 | B2 | 1/2016 | Zavolzhskiy et al. | |
| 9,488,042 | B2 | 11/2016 | Al-Nakhli et al. | |
| 10,081,759 | B2 | 9/2018 | Wernimont | |
| 10,202,833 | B2 | 2/2019 | Willberg et al. | |
| 11,268,017 | B2 * | 3/2022 | Al-Nakhli | C09K 8/516 |
| 2006/0144591 | A1 * | 7/2006 | Gonzalez | E21B 29/10 166/57 |
| 2009/0107671 | A1 * | 4/2009 | Waters | E21B 43/26 166/280.1 |
| 2016/0076351 | A1 | 3/2016 | Stehle | |

(Continued)

OTHER PUBLICATIONS

Ahmed Farid Ibrahim, et al., "Evaluation of the Breakdown Pressure to Initiate Hydraulic Fractures of Tight Sandstone and Shale Formations", SPE Trinidad and Tobago Section Energy Resources Conference, Port of Spain, Trinidad and Tobago, Jun. 2018.

(Continued)

*Primary Examiner* — Silvana C Runyan
(74) *Attorney, Agent, or Firm* — Bracewell LLP; Constance G. Rhebergen; Eleanor L. Tyson

(57) ABSTRACT

Compositions and methods for increasing a stimulated reservoir volume in a hydrocarbon-bearing formation in fluid communication with a wellbore, one method including drilling a plurality of lateral extensions at varying depths in the formation extending from a vertical wellbore using slickwater hydraulic fracturing fluid, the slickwater hydraulic fracturing fluid comprising at least one friction reducer; and injecting an exothermic reaction component into the plurality of lateral extensions to create a plurality of fractures extending outwardly from and between the plurality of lateral extensions to create a multilateral fracture network.

27 Claims, 7 Drawing Sheets

(56) References Cited

U.S. PATENT DOCUMENTS

| | | | | |
|---|---|---|---|---|
| 2019/0128105 | A1* | 5/2019 | Al-Mulhem | E21B 7/04 |
| 2019/0153844 | A1 | 5/2019 | Phatak et al. | |
| 2020/0165576 | A1 | 5/2020 | Gradinaru et al. | |
| 2020/0355052 | A1* | 11/2020 | Al-Nakhli | E21B 43/26 |

OTHER PUBLICATIONS

Ahmed M. Gomaa, et al., "New Insights into Shale Fracturing Treatment Design", SPE/EAGE European Unconventional Resources Conference and Exhibition, Vienna, Austria, Feb. 2014.

Ahmed M. Gomaa, et al., "New Insights into Hydraulic Fracturing of Shale Formations", International Petroleum Technology Conference, Doha, Qatar, Jan. 2014.

Al Qahtani, Abdullah M., "A New Technique and Field Application for Determining Reservoir Characteristics from Well Performance Data", SPE Middle East Oil Show, Manama, Bahrain, Mar. 2001.

Ayman R. Al-Nakhli, et al., "Chemically-Induced Pressure Pulse to Increase Stimulated Reservoir Volume in Unconventional Reservoirs", SPE/AAPG/SEG Unconventional Resources Technology Conference, Denver, Colorado, USA, Aug. 2014.

B. P. Fahrman et al., "Visualizing Well System Breakdown: Experimental and Numerical Analyses", 51st U.S. Rock Mechanics/Geomechanics Symposium, San Francisco, California, USA, Jun. 2017.

B.C. Haimson et al., "Hydraulic fracturing breakdown pressure and in situ stress at great depth", SRM International Symposium, Pau, France, Aug. 1989.

C. Mark Pearson, et al., "An Investigation Into the Use of High Pressure Nitrogen Breakdown Treatments Prior to Hydraulic Fracturing", SPE Western Regional Meeting, Anchorage, Alaska, May 1996.

Dmitriy Garagash et al., "Influence of Pressurization Rate on Borehole Breakdown Pressure in Impermeable Rocks", 2nd North American Rock Mechanics Symposium, Montreal, Quebec, Canada, pp. 1075-1080, Jun. 1996.

Jorge Boscan, et al., "Propellant Perforation Breakdown Technique: Eastern Venezuela Field Applications", SPE International Improved Oil Recovery Conference in Asia Pacific held in Kuala Lumpur, Malaysia, Oct. 20-21, 2003.

K.E. Gray et al. "Stress State, Porosity, Permeability and Breakdown Pressure Around a Borehole During Fluid Injection", USRMS, Cambridge, Massachusetts, Jun. 1981.

Maksim Oparin, et al., "Impact of Local Stress Heterogeneity on Fracture Initiation in Unconventional Reservoirs: A Case Study from Saudi Arabia", SPE Annual Technical Conference and Exhibition, Dubai, UAE, Sep. 2016.

R. Zillur, et al., "Hydraulic Fracturing Case Histories in the Carbonate and Sandstone Reservoirs of Khuff and Pre-Khuff Fomnations, Ghawar Field, Saudi Arabia", PE Annual Technical Conference and Exhibition, San Antonio, TX, Sep. 2002.

Simon Falser et al., "Reducing Breakdown Pressure and Fracture Tortuosity by In-Plane Perforations and Cyclic Pressure Ramping", 50th U.S. Rock Mechanics/Geomechanics Symposium, Houston, Texas, Jun. 2016.

* cited by examiner

SLICKWATER HYDRAULIC FRACTURING WITH EXOTHERMIC REACTANTS

BACKGROUND

Field

The present disclosure relates generally to the enhanced recovery of hydrocarbons in a hydrocarbon-bearing formation drilled with multiple lateral sections. Specifically, the disclosure relates to the use of slickwater hydraulic fracturing with an exothermic reaction component.

Description of the Related Art

Oil and gas wells in reservoirs, including tight reservoirs, are stimulated by hydraulic fracturing, which is a field practice to enhance hydrocarbon production from otherwise uneconomic wells. Hydraulic fracturing operations can be applied in open-hole or cased-hole recovery wells. In general, fracturing processes are carried out using completions that will isolate part of a horizontal well section, perforate casing if the well is cased, and then pump the fracturing fluid to initiate and propagate fractures in one or more lateral extensions. In some cases, tight formations have greater stress values, and rock with greater compressive strength values creates difficulty propagating fractures using hydraulic fracturing. As a result, drillers sometimes use multilateral wells to compensate and maximize the surface area that connects a recovery well to a hydrocarbon-bearing reservoir by drilling several laterals from the main vertical well using underbalanced coiled tubing drilling. This method can be used in unconventional gas reservoirs, which have low permeability, for example.

A conventionally practiced method of stimulating a horizontal lateral is by the multistage fracturing technique (MSF). However, this method is very expensive, logistically-challenging, and costly in drilling, completion, and stimulation, and oftentimes has a limited effect in making economic wells.

Slickwater or slickwater fracturing generally refers to a method or system of fracking involving adding chemicals to water to increase the fluid flow via reduced viscosity. In some instances, fluid is pumped down the wellbore as fast as 100 bbl/min. to fracture shale, for example. Without using slick water, pumping rates are about 60 bbl/min.

Slickwater systems and processes generally include friction reducers, for example polyacrylamide. Biocides, surfactants, and scale inhibitors can also be used. Friction reducers help speed application of the mixture. Biocides such as bromine prevent organisms from clogging fractures and creating scale downhole. Surfactants help keep sand and/or other proppants suspended. Methanol and naphthalene can be used for biocides. Hydrochloric acid and ethylene glycol may be utilized as scale inhibitors. Butanol and ethylene glycol monobutyl ether (2-BE) are used in surfactants. Slick water typically uses more water than earlier fracturing methods.

Improvements to slickwater and hydraulic fracturing are needed to create more effective fracture networks for hydrocarbon recovery, including crude oil and natural gas, from reservoirs, including unconventional reservoirs such as tight sandstone.

SUMMARY

The present disclosure shows multilateral well completion with slickwater hydraulic fracturing including one or more exothermic reaction component, having surprising and unexpected advantages with respect to increasing hydrocarbon-recovery through multilateral fracture networks. One or more exothermic reaction component is pumped or injected into laterals extending from a vertical wellbore, for example before, during, or after hydraulic fracturing with slickwater compositions. An open-hole or cased-hole recovery well can be used to inject the exothermic reaction component to create mini-fractures between laterals at different vertical heights in a hydrocarbon-bearing formation, for example a tight formation or a carbonate or sandstone formation. Multilateral fracture networks help maximize reservoir contact with multilateral recovery laterals and enhance well productivity and economics.

The application of thermo-chemical technology in unconventional reservoirs (such as tight shale and tight sandstone) creates additional complex fracture networks around hydraulically-generated fractures, and both near and far field areas are targeted by triggering a controlled chemical reaction down hole, which can take place during in addition to or alternative to after hydraulic fracturing treatment. Downhole temperatures in the wellbore and reservoir are used, in some embodiments, to control the activation and near versus far field effects of an exothermic reaction component. In some embodiments, an exothermic chemical reaction generates a high pressure gas, for example nitrogen, high temperature, and a quick pressure pulse, which creates additional Stimulated Reservoir Volume (SRV). One or more pressure pulse creates micro-fractures extending from hydraulically-created fractures, and also reactivates (by shearing and slipping) existing natural fractures or micro-fractures, resulting in a more conductive path for the flow of the formation fluids, including crude oil and natural gas.

One exothermic reaction control mechanism is activation temperature of the fluid system (where reagents can be diluted and pH adjusted). Warm-up effects of the fluid system to be pumped into the wellbore, and formation temperatures at various depths and distance from the wellbore, can be taken into account to design the job in a sequential or staggered manner such that the reaction occurs at a designed or predetermined time (either during pumping of a slickwater hydraulic fracking fluid, or after pumping of a slickwater hydraulic fracking fluid is complete).

Another exothermic reaction control mechanism is the PH of a fluid medium (including slickwater hydraulic fracturing fluid by itself, slickwater mixed with an exothermic reaction component, or the exothermic reaction component by itself). Since slickwater fracking fluid systems generally have about a neutral pH of 7, adjustments can be made to control the activation of an exothermic reaction component at a given temperature and pressure. For example, reagents can be incorporated to increase the pH of a slickwater fracturing fluid in addition to or alternative to an exothermic reaction component. For some cross-linked fracturing fluids, a wider range of pH exists, so less adjustment can be required, depending on the fracking fluid system, such as a slickwater fracking fluid system.

In some embodiments, systems and methods of multilateral horizontal drilling, and optionally fracturing, with underbalanced coiled tubing drilling along with one or more exothermic reaction components, in some embodiments, reduces or eliminates damage caused by drilling fluids in certain overbalanced drilling operations. Also, one or more exothermic reaction components of the present disclosure create small fractures that maximize reservoir contact with recovery laterals, and therefore improve well productivity.

In some embodiments disclosed here, slickwater hydraulic fracturing fluids containing a given concentration of one or more exothermic reaction component are pumped continuously during an entire frack job with a conventional pump schedule as to the amount of fluid and proppant injection rates and volumes. The exothermic reaction component can be designed to react at a given or predetermined time in addition to or alternative to a given or predetermined depth in addition to or alternative to a predetermined lateral distance away from a wellbore by controlling the concentration of exothermic reaction component in the slickwater hydraulic fracturing fluid in addition to or alternative to the pH. In some embodiments, the in situ pressure of a wellbore or reservoir is also used to control the reaction of an exothermic reaction component in slickwater, and in other embodiments microwave application can be used to activate an exothermic reaction component by lowering the activation energy and activating the exothermic reaction component without a substantial increase in temperature.

In some embodiments, slickwater hydraulic fracturing fluid containing a given concentration of one or more exothermic reaction component can be pumped intermittently or alternatingly with other fluids, such as slickwater without an exothermic reaction component, and the sweeps with slickwater hydraulic fracturing fluid containing a given concentration of one or more exothermic reaction component are optimized to increase fracture networks propagating from hydraulically-induced fractures.

In some embodiments, slickwater hydraulic fracturing fluid containing a given concentration of one or more exothermic reaction component can exhibit a reduced amount of proppant compared to a slickwater hydraulic fracturing fluid without an exothermic reaction component. For example, in a hydraulic fracking schedule, certain proppant ramps can be replaced with injection of an exothermic reaction component or a slickwater hydraulic fracturing fluid containing one or more exothermic reaction component. In some embodiments, the need for proppant is eliminated by the creation of multilateral fracture networks via slickwater hydraulic fracturing with an exothermic reaction component.

Therefore, disclosed here are methods of increasing a stimulated reservoir volume in a hydrocarbon-bearing formation in fluid communication with a wellbore, one method comprising the steps of: drilling a plurality of lateral extensions at varying depths in the formation extending from a vertical wellbore using slickwater hydraulic fracturing fluid, the slickwater hydraulic fracturing fluid comprising at least one friction reducer; and injecting an exothermic reaction component into the plurality of lateral extensions to create a plurality of fractures extending outwardly from and between the plurality of lateral extensions to create a multilateral fracture network. In some embodiments, the steps of drilling and injecting are carried out simultaneously. In other embodiments, the step of injecting is carried out after the step of drilling. Still in other embodiments, the method further including the use of concentric coiled tubing operable to inject components of the exothermic reaction component separately such that the exothermic reaction component reacts to produce pressure and heat once disposed in a lateral extension of the plurality of lateral extensions.

In some embodiments, the method further includes mixing the exothermic reaction component in an aqueous solution to achieve a pre-selected solution pH, wherein the exothermic reaction component is operable to react at a pre-selected reservoir temperature to generate a pressure pulse; injecting the fracturing fluid into the wellbore in the hydrocarbon-bearing formation; and generating a pressure pulse when the exothermic reaction component reaches the pre-selected reservoir temperature, such that the pressure pulse is operable to create at least a portion of the plurality of fractures.

In some embodiments, the exothermic reaction component comprises an ammonium containing compound and a nitrite containing compound. Still in other embodiments, the ammonium containing compound comprises $NH_4Cl$ and the nitrite containing compound comprises $NaNO_2$. In yet other embodiments, the pre-selected solution pH is between 5.7 and 9. In some embodiments, the reservoir temperature is in a range between 48.8° C. (120° F.) and 121.1° C. (250° F.). In certain embodiments, the pressure pulse is between 500 psi and 50,000 psi. Still in other embodiments, the pressure pulse creates fractures in less than 10 seconds. In some embodiments, the pressure pulse creates fractures in less than 5 seconds. In other embodiments, the slickwater hydraulic fracturing fluid further comprises at least one component selected from the group consisting of: a biocide, a surfactant, and a scale inhibitor. Still in other embodiments, mixing the exothermic reaction component with the slickwater hydraulic fracturing fluid causes a less than 20% change to an original viscosity of the slickwater hydraulic fracturing fluid.

In other embodiments of the method, mixing the exothermic reaction component with the slickwater hydraulic fracturing fluid causes a less than 10% change to an original viscosity of the slickwater hydraulic fracturing fluid. Still in other embodiments, the exothermic reaction component is injected at between about 1 volume % and about 50 volume % of total fluids injected during the steps of drilling and injecting. In yet other embodiments, the exothermic reaction component is injected at between about 10 volume % and about 30 volume % of total fluids injected during the steps of drilling and injecting. Still in other embodiments, the steps of drilling and injecting are each repeated at least twice and are carried out alternatingly.

In certain other embodiments, the exothermic reaction component causes a non-combustive redox reaction to quickly release heat and gas to create at least a portion of the plurality of fractures. Still in other embodiments, the step of injecting the exothermic reaction component reduces required application of proppant by between about 100 lbs. and about 10,000 lbs. of proppant.

Additionally disclosed here are hydraulic fracturing fluid compositions including slickwater hydraulic fracturing fluid, wherein the slickwater hydraulic fracturing fluid comprises at least one friction reducer, and an aqueous exothermic reaction component composition, wherein the aqueous exothermic reaction component composition comprises between about 1 volume % and about 50 volume % of the hydraulic fracturing fluid composition and changes an initial viscosity of the slickwater hydraulic fracturing fluid by less than about 20%, and wherein the aqueous exothermic reaction component composition has a pre-determined initial pH to react in situ in a hydrocarbon bearing formation proximate a formation temperature to release heat and gas through a non-combustive redox reaction for creating a plurality of fractures in the hydrocarbon bearing formation.

In some embodiments, the aqueous exothermic reaction component composition changes an initial viscosity of the slickwater hydraulic fracturing fluid by less than about 10%. Still in other embodiments, the exothermic reaction component comprises an ammonium containing compound and a nitrite containing compound in a molar ratio between about 9:1 to 1:9. Still in other embodiments, the ammonium containing compound comprises $NH_4Cl$ and the nitrite containing compound comprises $NaNO_2$. In yet other embodiments, the pre-determined initial pH is between 5.7 and 9. In certain embodiments, the slickwater hydraulic fracturing fluid further comprises at least one component selected from the group consisting of: a biocide, a surfactant, and a scale inhibitor. Still in other embodiments, the compositions include a hydroxide compound to modify pH of the hydraulic fracturing fluid composition. Certain embodiments of the compositions further include proppants, such as sand or ceramic materials. In some embodiments, the at least one friction reducer comprises polyacrylamide.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION

So that the manner in which the features and advantages of the embodiments of systems of and methods of making multilateral fracture networks with slickwater hydraulic fracturing and one or more exothermic reaction component, as well as others, which will become apparent, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Figure 1:
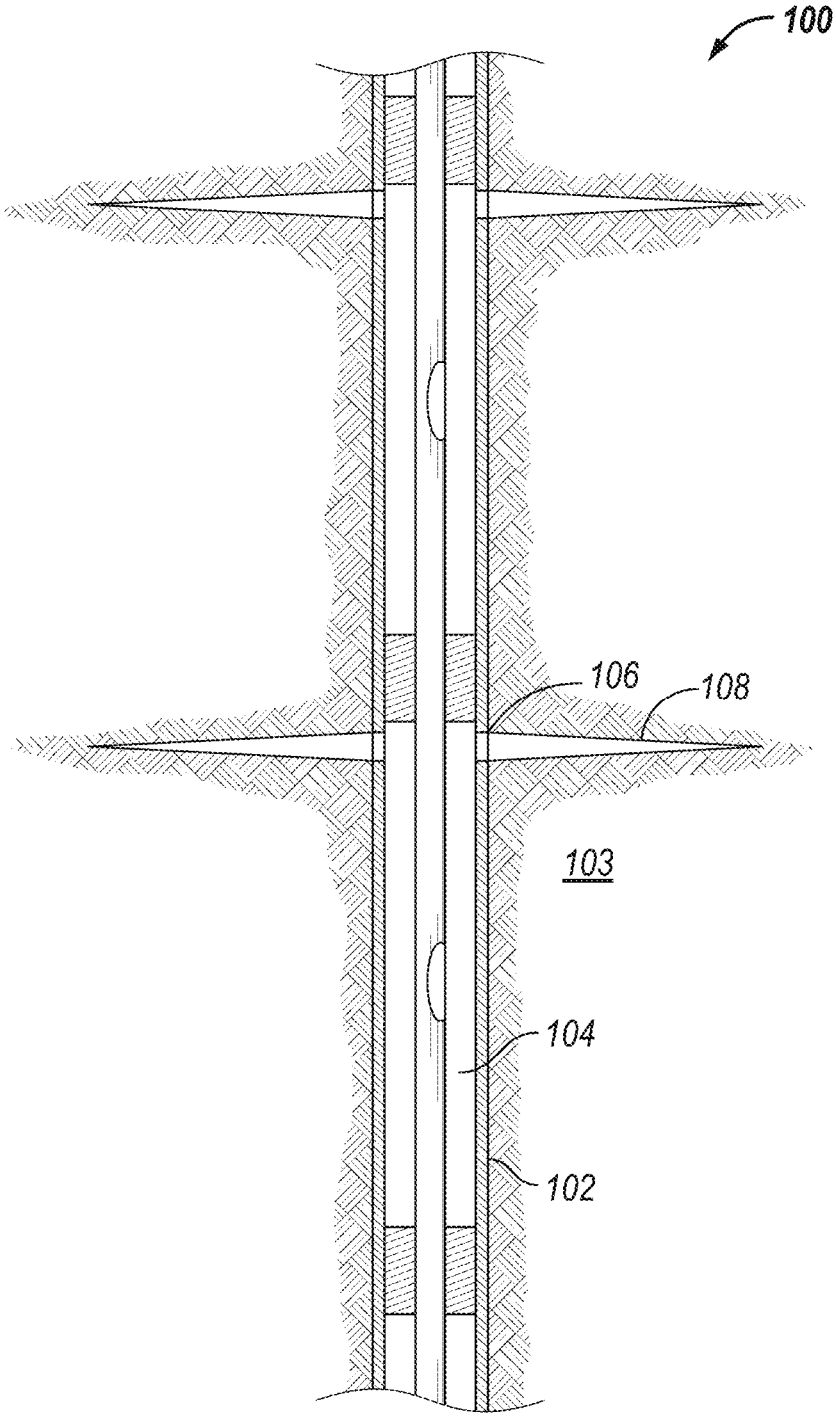
FIG. 1 (Prior Art)
FIG. 1 is a schematic diagram of a prior art slickwater hydraulic fracturing system in a wellbore with lateral fractures proceeding into a reservoir.

Referring first to FIG. 1, a schematic diagram is shown of a prior art slickwater hydraulic fracturing system in a wellbore with lateral fractures proceeding into a reservoir. In wellbore system 100, wellbore 102, either cased or open-hole, proceeds in situ into a hydrocarbon-bearing reservoir 103, and production tubing 104 is disposed within the annulus of wellbore 102. Lateral fractures 108 proceed laterally outwardly from wellbore 102 into hydrocarbon-bearing reservoir 103, in the embodiment shown substantially perpendicular to wellbore 102. Oil, gas, and other fluids are transmitted from hydrocarbon-bearing reservoir 103 through lateral fractures 108 to production tubing 104 at production points 106, which in some embodiments can include perforations. Thereby, oil, gas, and other fluids are transmitted from hydrocarbon-bearing reservoir 103 through production tubing 104 to the surface. In the embodiment shown, lateral fractures 108 are created by lateral hydraulic fracturing with slickwater hydraulic fracturing fluid at a pressure greater than the breakdown pressure of the rock in hydrocarbon-bearing reservoir 103.

Slick water or slickwater fracturing generally refers to a method or system of fracking involving adding chemicals to water to increase the fluid flow via reduced viscosity. In some instances, fluid is pumped down the wellbore as fast as 100 bbl/min. to fracture shale, for example. Without using slick water, pumping rates are about 60 bbl/min.

Slick water systems and processes generally include friction reducers, for example polyacrylamides. Biocides, surfactants, and scale inhibitors can also be used. Friction reducers help speed application of the mixture. Biocides such as bromine prevent organisms from clogging fractures and creating scale downhole. Surfactants help keep sand and/or other proppants suspended. Methanol and naphthalene can be used for biocides. Hydrochloric acid and ethylene glycol may be utilized as scale inhibitors. Butanol and ethylene glycol monobutyl ether (2-BE) are used in surfactants. Slickwater typically uses more water than earlier fracturing methods.

Figure 2:
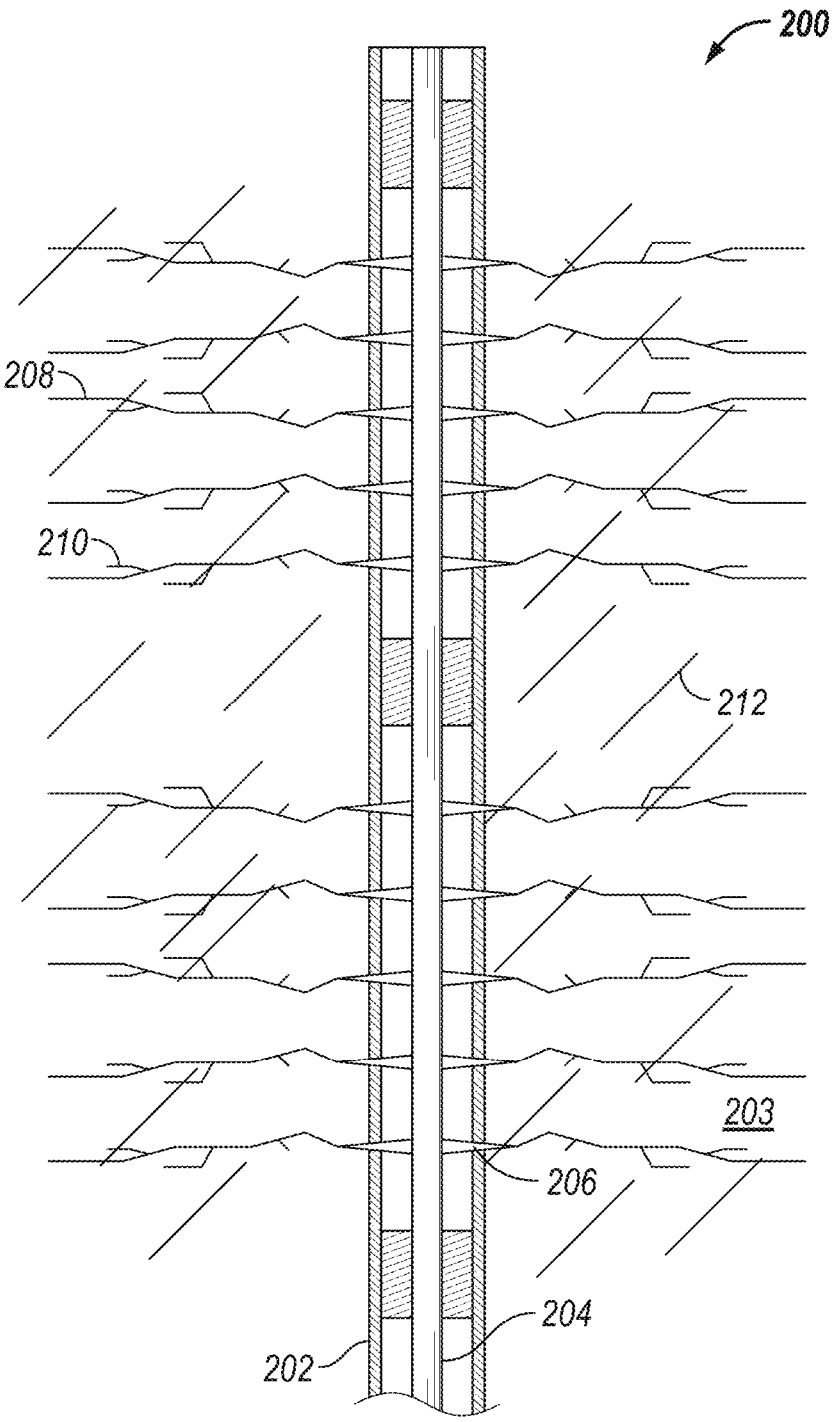
FIG. 2 is a schematic diagram of a fracture network created in embodiments of the present disclosure using slickwater hydraulic fracturing with an exothermic reaction component.

FIG. 2 is a schematic diagram of a fracture network created in embodiments of the present disclosure using slickwater hydraulic fracturing with an exothermic reaction component. In wellbore system 200, wellbore 202, either cased or open-hole, proceeds in situ into a hydrocarbon-bearing reservoir 203, and production tubing 204 is disposed within the annulus of wellbore 202. Lateral fractures 208 proceed laterally outwardly from wellbore 102 into hydrocarbon-bearing reservoir 203, in the embodiment shown substantially perpendicular to wellbore 202. Oil, gas, and other fluids are transmitted from hydrocarbon-bearing reservoir 203 through lateral fractures 208 to production tubing 204 at production points 206, which in some embodiments can include perforations. Thereby, oil, gas, and other fluids are transmitted from hydrocarbon-bearing reservoir 203 through production tubing 204 to the surface. In the embodiment shown, lateral fractures 208 are created by lateral hydraulic fracturing with slickwater hydraulic fracturing fluid.

In FIG. 2, lateral extension fractures 210 proceed outwardly from lateral fractures 208 and are disposed between and throughout lateral fractures 208. In some embodiments, lateral extension fractures 210 fluidly connect separate lateral fractures 208. In the embodiment shown, lateral extension fractures 210 are created by one or more pressure pulse during the application of one or more exothermic reaction component during one or more fluid injection stages, with or without slickwater. One or more exothermic reaction component can be injected into lateral fractures 208 during creation of lateral fractures 208 with slickwater hydraulic fracturing fluid to create lateral extension fractures 210, and/or one or more exothermic reaction component can be injected into lateral fractures 208 after creation of lateral fractures 208 with slickwater hydraulic fracturing fluid to create lateral extension fractures 210.

Also in FIG. 2, transverse fractures 212 are shown disposed between lateral fractures 208 and lateral extension fractures 210. Transverse fractures 212 can fluidly connect one or more lateral fracture 208 and/or one or more lateral extension fracture 210. In the embodiment shown, transverse fractures 212 are created by one or more pressure pulse during the application of one or more exothermic reaction component during one or more fluid injection stages. One or more exothermic reaction component can be injected into lateral fractures 208 and/or lateral extension fractures 210 during creation of lateral fractures 208 and/or lateral extension fractures 210 with slickwater hydraulic fracturing fluid to create transverse fractures 212, and/or one or more exothermic reaction component can be injected into lateral fractures 208 and/or lateral extension fractures 210 after creation of lateral fractures 208 and/or lateral extension fractures 210 with slickwater hydraulic fracturing fluid to create transverse fractures 212.

Using an exothermic reaction component with slickwater hydraulic fracturing fluids allows for the creation of a fracture network comprising lateral fractures 208, lateral extension fractures 210, and transverse fractures 212. The fracture network of FIG. 2 comprising lateral fractures 208, lateral extension fractures 210, and transverse fractures 212 allows for increased fluid recovery to the surface of oil, gas, and other fluids versus the prior art system of FIG. 1. In some embodiments, lateral extension fractures 210 and/or transverse fractures 212 comprise micro-fractures, or fractures smaller than lateral fractures, 208. In some embodiments, lateral extension fractures 210 and/or transverse fractures 212 comprise enhanced natural fractures, such as pre-existing fractures in hydrocarbon-bearing reservoir 203. In the embodiment of FIG. 2, by use of the exothermic reaction component, proppant injection, such as sand or ceramic material, can be reduced or eliminated which prevents blocking of fractures and production points 206.

Figure 3:
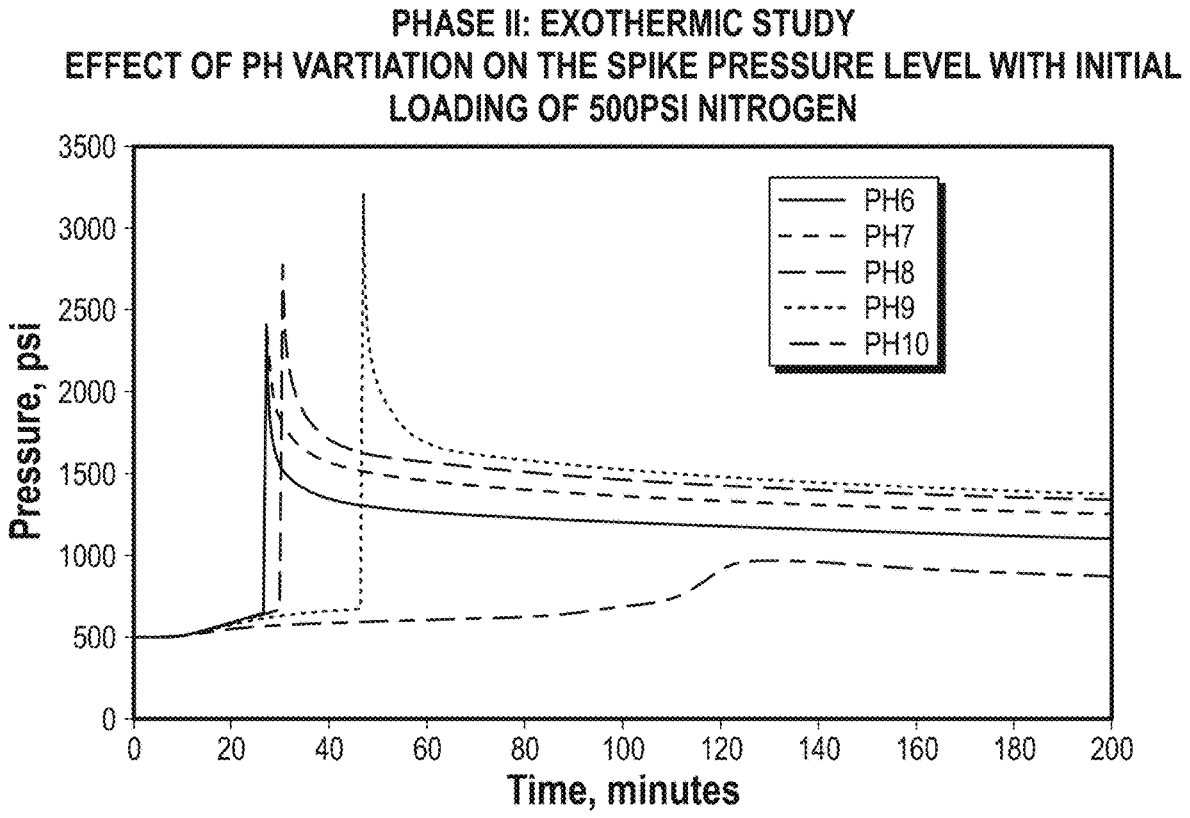
FIG. 3 is a graph showing varying-pressure pressure pulses created at varying pH for an exothermic reaction component.

FIG. 3 is a graph showing varying-pressure pressure pulses created at varying pH for an exothermic reaction component. As shown at greater pH values, the exothermic reaction activation time increases (shown by the sharp spikes in pressure, or a pressure pulse). Additionally, greater pressure pulses are obtained proceeding from pH 6 to pH 7 to pH 8 to pH 9. In some embodiments, different pH values of an exothermic reaction component mixed with slickwater fracturing fluid can be used in different stages of a fracturing operation, and the exothermic reaction causing a pressure pulse would be triggered at different times and/or temperatures (see also FIG. 4). By controlling exothermic reaction component activation time through pH and/or activation temperature and/or application of microwaves, the reaction can be controlled according to depth in a wellbore and/or lateral distance from a wellbore into a hydrocarbon-bearing reservoir. For example, where a greater-pressure pressure pulse is desired at a further lateral distance from a wellbore, a greater pH such as pH 9 can be applied in a slickwater formulation comprising the exothermic reaction component to delay activation of the reaction and have the reaction occur at a greater lateral distance from the wellbore.

As noted, pH also affects the reaction triggering temperature, so once again greater pH values can be used to have deeper stimulation of a hydrocarbon-bearing reservoir. The pH of slickwater hydraulic fracturing fluid formulations with one or more exothermic reaction component can be fixed to one value, or changed during various pumping stages to have deeper and deeper stimulation. For example, pumping in one stage can start with pH 7, and then be increased to pH 8, pH 9, and pH 10 while pumping in various stages. Basic reagents, such as sodium hydroxide, can be added to slick water to increase pH without otherwise impacting the slickwater, described further infra.

Figure 4:
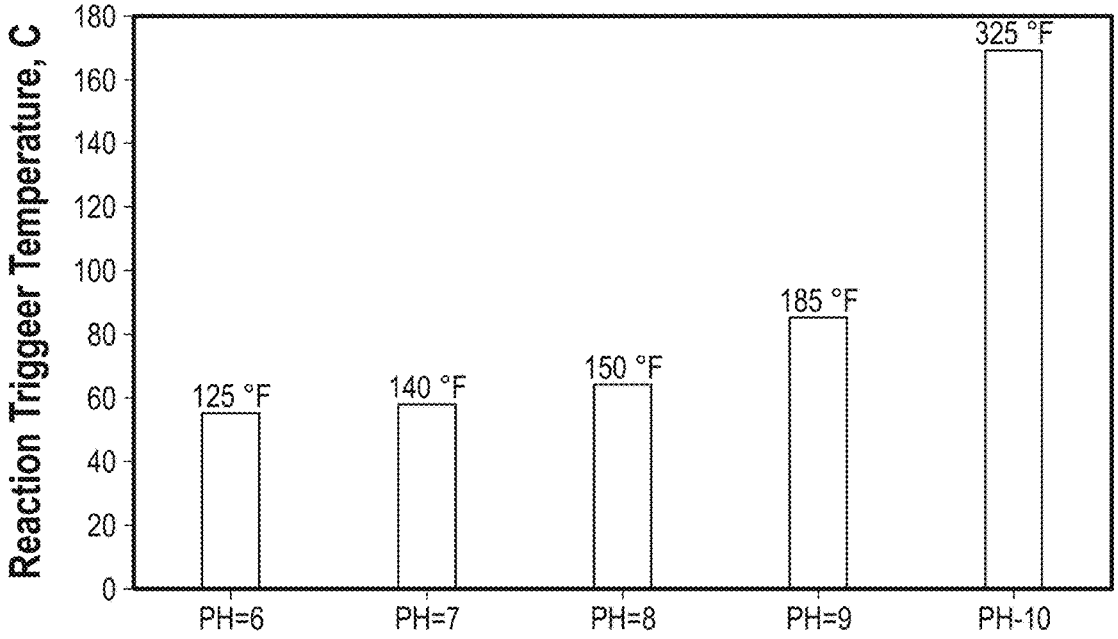
FIG. 4 is a graph showing varying reaction triggering or activation temperatures at varying pH for an exothermic reaction component.

FIG. 4 is a graph showing varying reaction triggering or activation temperatures at varying pH for an exothermic reaction component. As shown, the reaction triggering temperature of one or more exothermic reaction component, optionally mixed with slickwater hydraulic fracturing fluid, can increase with increasing pH, and as described with regard to FIG. 3 allows for increased fracturing via increased pressure pulses at increased depths and/or increased lateral distances from a wellbore. In some embodiments, an exothermic reaction component includes an ammonium ion and a nitrite ion, for example ammonium chloride and sodium nitrite, with each between about 1 molar and 9 molar in solution, optionally at a 1:1 molar ratio.

Figure 5:
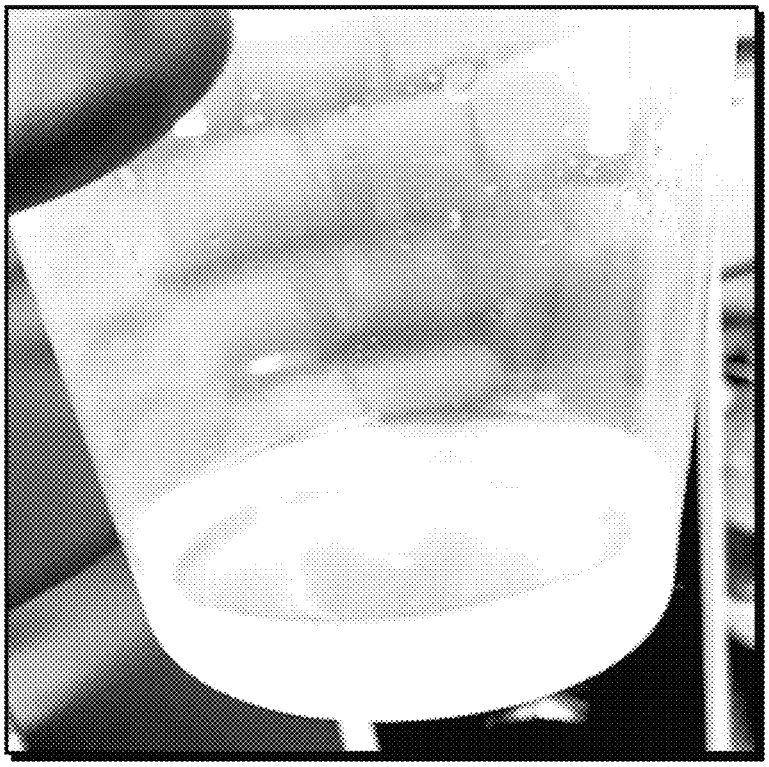
FIG. 5 is a pictorial representation of a low-viscosity slickwater fracturing fluid mixed with an exothermic reaction component, which maintains low viscosity for use as slickwater.

FIG. 5 is a pictorial representation of a low-viscosity slickwater fracturing fluid mixed with an exothermic reaction component, which maintains low viscosity for use as slickwater. Laboratory testing showed no compatibility issues or precipitation when adding an exothermic thermochemical reagent to slick water. Different water sources, with different friction reducers, were tested and all showed no compatibility issues with aqueous exothermic thermochemical additives. The effects of exothermic thermochemicals on slickwater viscosity were studied. There was no significant effect on viscosity, as described in FIG. 6.

Figure 6:
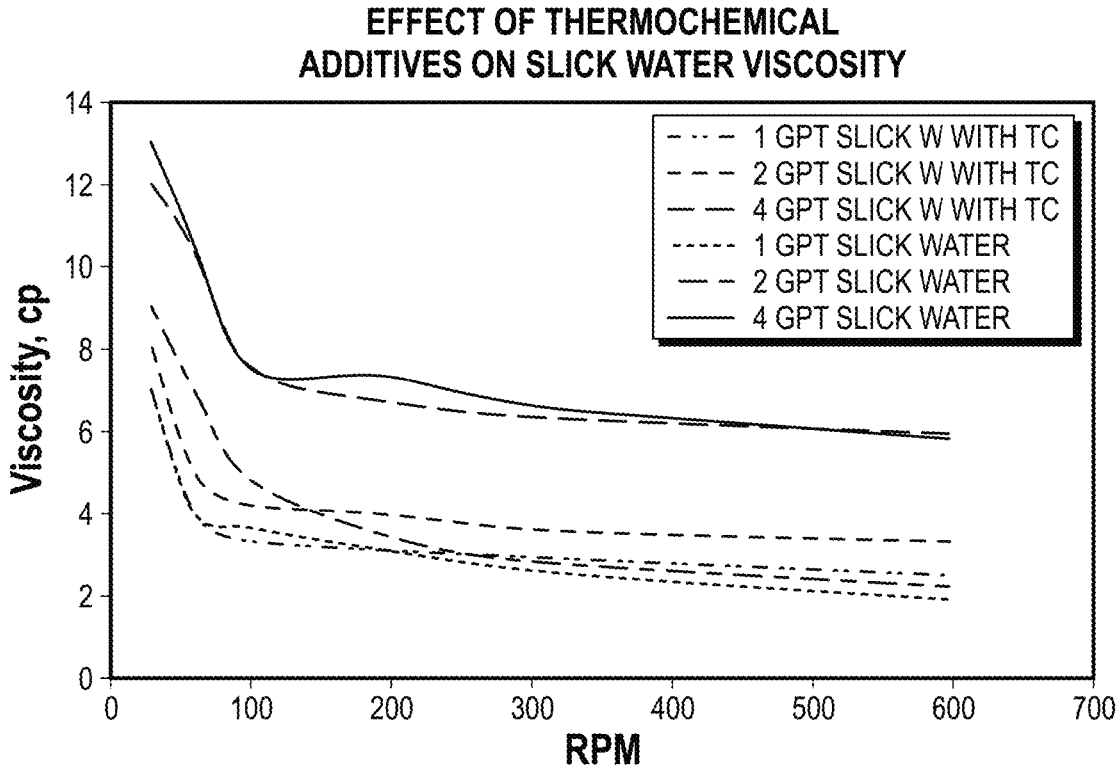
FIG. 6 is a graph showing the viscosity effects of adding an exothermic reaction component at varying concentrations to slickwater hydraulic fracturing fluid.

FIG. 6 is a graph showing the viscosity effects of adding an exothermic reaction component at varying concentrations to slickwater hydraulic fracturing fluid. As shown for slickwater compositions between 1 gallon slickwater additive per 1,000 gallons water (gpt) to 4 gpt, the addition of thermochemicals (TC) does not substantially alter the viscosity, for example the viscosity change is less than about 20% or less than about 10%.

Plug samples of 2 inch by 3 inch Eagle Ford and Scioto sandstone were fractured, using slickwater and thermochemicals as fracturing fluids (FIGS. 7 and 8). With thermochemical application, the plugs were completely split apart, while with slickwater alone the fractures were smaller and the rocks did not split apart. Therefore, thermochemicals can create extra fracturing beyond conventional hydraulic fracturing with slickwater, and surprisingly and unexpectedly a larger stimulated reservoir volume (SRV) is created.

Figure 7A:
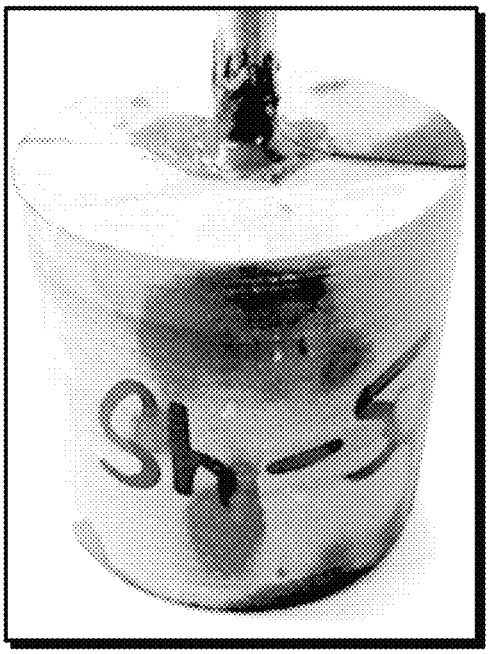
FIG. 7A is a pictorial representation of an Eagle Ford shale column hydraulically fractured with conventional fracturing fluid.
Figure 7B:
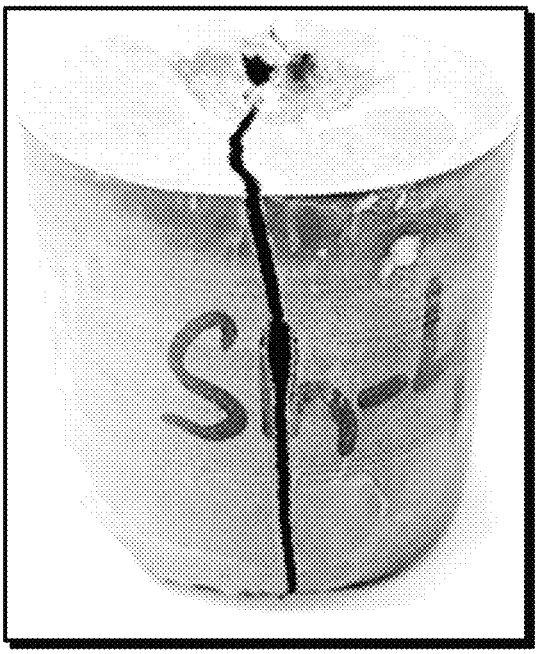
FIG. 7B is a pictorial representation of an Eagle Ford shale column fractured using an exothermic reaction of an exothermic reaction component.
Figure 7C:
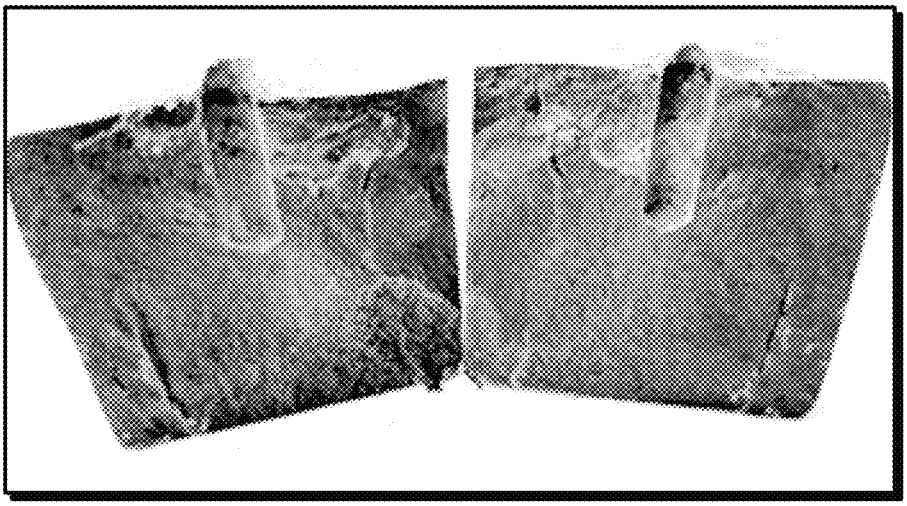
FIG. 7C is a cross-sectional pictorial representation of the Eagle Ford shale column fractured using the exothermic reaction of an exothermic reaction component from FIG. 7B.

FIG. 7A is a pictorial representation of an Eagle Ford shale column hydraulically fractured with conventional slickwater fracturing fluid. FIG. 7B is a pictorial representation of an Eagle Ford shale column fractured using an exothermic reaction of an exothermic reaction component. FIG. 7C is a cross-sectional pictorial representation of the Eagle Ford shale column fractured using the exothermic reaction of an exothermic reaction component from FIG. 7B.

Figure 8A:
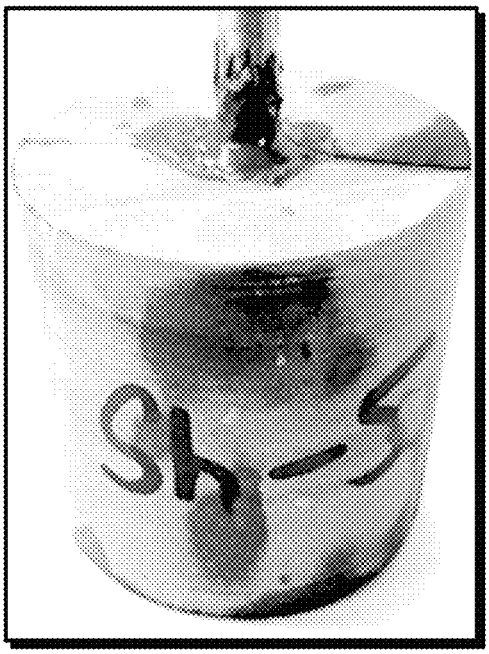
FIG. 8A is a pictorial representation of a Scioto sandstone column hydraulically fractured with conventional fracturing fluid.
Figure 8B:
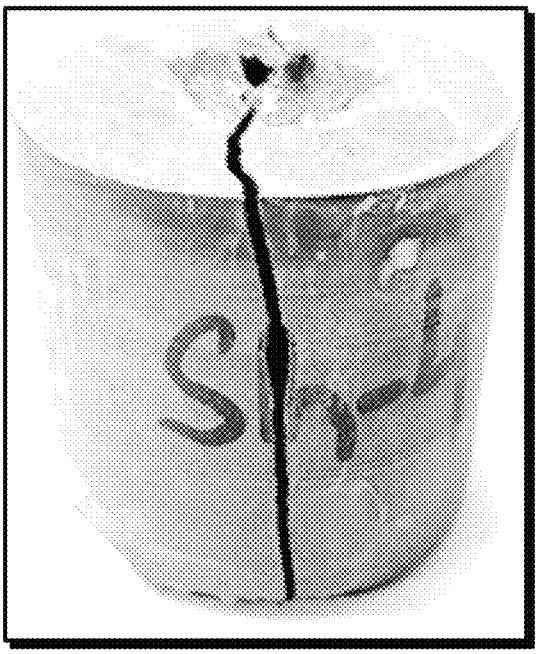
FIG. 8B is a pictorial representation of a Scioto sandstone column fractured using an exothermic reaction of an exothermic reaction component.
Figure 8C:
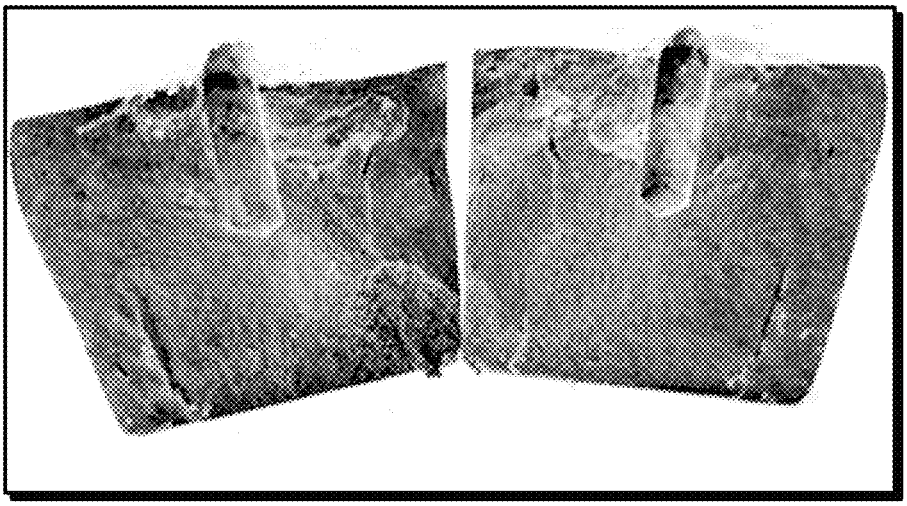
FIG. 8C is a cross-sectional pictorial representation of the Scioto sandstone column fractured using the exothermic reaction of an exothermic reaction component from FIG. 8B.

FIG. 8A is a pictorial representation of a Scioto sandstone column hydraulically fractured with conventional slickwater fracturing fluid. FIG. 8B is a pictorial representation of a Scioto sandstone column fractured using an exothermic reaction of an exothermic reaction component. FIG. 8C is a cross-sectional pictorial representation of the Scioto sandstone column fractured using the exothermic reaction of an exothermic reaction component from FIG. 8B.

Figure 9:
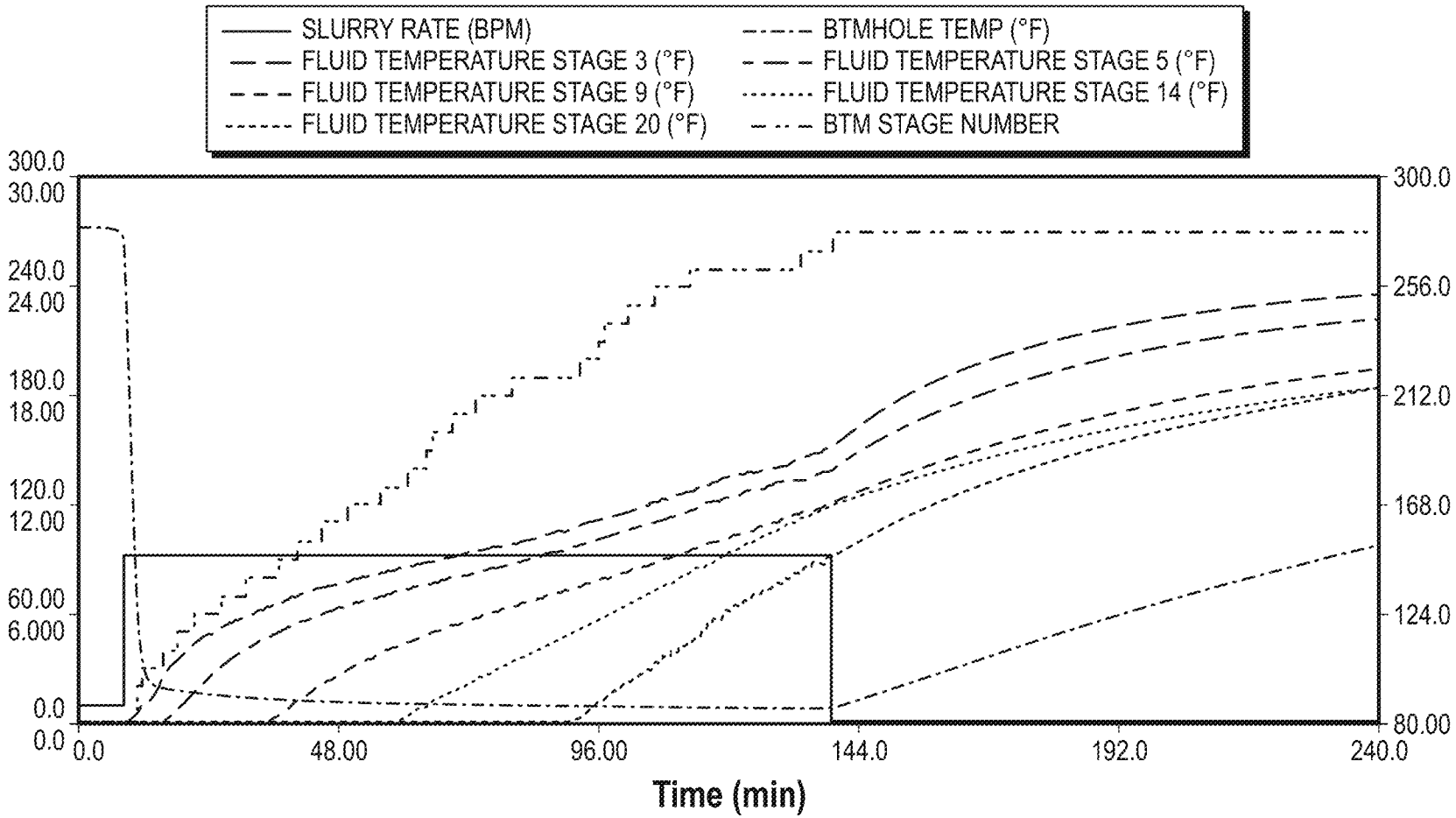
FIG. 9 is a graph representing a pumping sequence for slickwater hydraulic fracturing fluid and an exothermic reaction component.

FIG. 9 is a graph representing a pumping sequence for slickwater hydraulic fracturing fluid and an exothermic reaction component. The cooling effect of a fracturing fluid on downhole temperature was simulated as show in FIG. 9. FIG. 9 shows that having the exothermic reaction triggering temperature around 140° F. is sufficient to have the reaction pulse inside the reservoir, so multiple side fractures will be created around the main induced hydraulic fractures.

One sequence of pumping thermochemicals with slickwater during hydraulic fracturing of an unconventional well is described in Table 1. For fracturing one stage of an unconventional well, five fracture clusters will be created, in the example shown. For each cluster, 400 barrels of thermochemicals will be injected to create multiple fractures around the cluster. Volumes of thermochemical fluid and the number of stages can vary depending on the well and reservoir conditions.

TABLE 1

Example Pumping Sequence for Exothermic Thermochemicals with Slickwater Hydraulic Fracturing Fluid During Fracturing of an Unconventional Reservoir.

| Well Stage | Fluid Type | Pump Rate in Barrels per Minute (bpm) |
|---|---|---|
| Est. Rate | Slickwater (SW) | 10 |
| Acid Injection | 15 wt. % HCl | 10 |
| Spacer | SW | 15 |
| PAD 1 | Exothermic Thermochemicals | 92 |
| Slug 1 | SW | 92 |
| PAD 2 | Exothermic Thermochemicals | 92 |
| 0.25 pound proppant added per thousand gallons fluid (PPA) | SW | 92 |
| 0.5 PPA | SW | 92 |
| 0.75 PPA | SW | 92 |
| Sweep 1 | Exothermic Thermochemicals | 92 |
| 0.5 PPA | SW | 92 |
| 0.75 PPA | SW | 92 |
| 1.0 PPA | SW | 92 |
| 1.25 PPA | SW | 92 |
| Sweep 2 | Exothermic Thermochemicals | 92 |
| 0.5 PPA | SW | 92 |
| 0.75 PPA | SW | 92 |
| 1.0 PPA | SW | 92 |
| 1.25 PPA | SW | 92 |
| Sweep 3 | Exothermic Thermochemicals | 92 |
| 0.5 PPA | SW | 92 |
| 0.75 PPA | SW | 92 |
| 1.0 PPA | SW | 92 |
| 1.25 PPA | SW | 92 |
| Flush | SW | 92 |
| Total | | |

TABLE 1

Continued. Example Pumping Sequence for Exothermic Thermochemicals with Slickwater Hydraulic Fracturing Fluid During Fracturing of an Unconventional Reservoir.

| | Slickwater Fracturing Design 350 Klbs. Design (90 -10%) | | | | | |
|---|---|---|---|---|---|---|
| Well Stage | Stage Volume (Gallons) | Total Volume (Barrels) | Prop-pant Conc. (PPA) | Cumu-lative Volume (Barrels) | Proppant Type | Proppant Volume (Pounds) |
| Est. Rate | 210 | 5 | 0.0 | 5.0 | None | n/a |
| Acid Injection | 3000 | 71 | 0.0 | 76.4 | None | n/a |
| Spacer | 2100 | 50 | 0.0 | 126.4 | None | n/a |
| PAD 1 | 16820 | 400 | 0.00 | 526.9 | None | n/a |
| Slug 1 | 4000 | 95 | 0.25 | 622.1 | 100 mesh | 1,000 |
| PAD 2 | 16820 | 400 | 0.00 | 1022.6 | None | n/a |
| 0.25 pounds proppant added per thousand gallons fluid (PPA) | 16000 | 381 | 0.25 | 457.4 | 100 mesh | 4,000 |
| 0.5 PPA | 18000 | 429 | 0.50 | 886.0 | 100 mesh | 9,000 |
| 0.75 PPA | 22000 | 524 | 0.75 | 1409.8 | 100 mesh | 16,500 |
| Sweep 1 | 16820 | 400 | 0.00 | 1810.2 | None | n/a |
| 0.5 PPA | 20000 | 476 | 0.50 | 2286.4 | 100 mesh | 10,000 |
| 0.75 PPA | 30000 | 714 | 0.75 | 3000.7 | 100 mesh | 22,500 |
| 1.0 PPA | 40000 | 952 | 1.00 | 3953.1 | 100 mesh | 40,000 |
| 1.25 PPA | 48000 | 1143 | 1.25 | 5096.0 | 100 mesh | 60,000 |
| Sweep 2 | 16820 | 400 | 0.00 | 5496.4 | None | n/a |
| 0.5 PPA | 18000 | 429 | 0.50 | 5925.0 | 100 mesh | 9,000 |
| 0.75 PPA | 30000 | 714 | 0.75 | 6639.3 | 100 mesh | 22,500 |
| 1.0 PPA | 45500 | 1083 | 1.00 | 7722.6 | 100 mesh | 45,500 |
| 1.25 PPA | 60000 | 1429 | 1.25 | 9151.2 | 100 mesh | 75,000 |
| Sweep 3 | 16820 | 400 | 0.00 | 9551.7 | None | n/a |
| 0.5 PPA | 10000 | 238 | 0.50 | 9789.8 | 40/70 light weight proppant (LWP) | 5,000 |
| 0.75 PPA | 12000 | 286 | 0.75 | 10075.5 | 40/70 LWP | 9,000 |
| 1.0 PPA | 17000 | 405 | 1.00 | 10480.2 | 40/70 LWP | 17,000 |
| 1.25 PPA | 4000 | 95 | 1.25 | 10575.5 | 40/70 LWP | 4,000 |
| Flush | 11500 | 274 | | 10849.3 | | n/a |
| Total | 495,410 | 11,795 | | | | 350,000 |

In some embodiments of the disclosure, a multilateral hydrocarbon recovery network in a hydrocarbon-bearing formation with a multilateral fracture network is drilled with underbalanced coiled tubing and fractured, in part, using an exothermic reaction component before, during or after slickwater treatment. Systems and methods can be applied in an open-hole recovery well or a cased-hole recovery well. If a vertical well is cased, perforations can be used to aid in the drilling of primary horizontal laterals. From primary laterals extend branched horizontal laterals at similar or variable vertical depths and horizontal lengths, depending on the target reservoir formation. From branched horizontal laterals extend one or more plurality of fractures forming an overall fracture network which increases recovery of hydrocarbons from the formation to the branched horizontal laterals and ultimately up through a vertical recovery well.

Horizontal laterals are generally about 100 feet (ft.) to about 300 ft., for example about 200 ft., vertically spaced apart and can be located at similar or variable vertical depths depending on the landing of the lateral in the target reservoir formation. Created fractures, such as for example lateral extension fractures 210 and transverse fractures 212 in FIG. 2, may extend from about 10 ft. to about 100 ft., for example about 50 ft., outwardly from a lateral depending on the mechanical properties of the formation. Mini-fractures may extend only about a few feet to about 10 ft., but a plurality of mini-fractures can greatly increase lateral connection to producing zones.

Multilateral wells of the present disclosure, including multilateral fracture networks, cause, in some embodiments, extreme reservoir contact (ERC). In some embodiments, a multilateral fracture network recovery system, such as that shown in wellbore system 200 in FIG. 2, can be drilled from a vertical well using a rotary drilling rig, and then several multilaterals can be drilled using underbalanced coiled tubing drilling, which is cost effective, efficient, and does not adversely affect a hydrocarbon-bearing formation by damaging rock permeability with drilling fluids, which can occur in conventional overbalanced drilling schemes and hydraulic fracturing.

Before, during, or after the drilling of multilaterals with slickwater, such as for example lateral fractures 208 in FIG. 2, one or more exothermic reaction component can be injected to further enhance the stimulated reservoir volume by creating mini-fractures, such as for example lateral extension fractures 210 and transverse fractures 212 in FIG. 2, and thus maximize reservoir contact with a recovery well.

Fracturing systems and methods of the present disclosure can be applied in, for example, tight formations, sandstone formations, carbonate formations, and in gas wells, including those wells in unconventional reservoirs with low permeability rocks. Fracturing fluids used in overbalanced drilling can be damaging to a formation's permeability, and the disclosed systems and methods here result in enhanced productivity of gas wells, for example. An exothermic reaction component, for example optionally containing one or more exothermic reacting chemicals, for example a nitrite ion and an ammonium ion, applied either separately or together before, during, or after slickwater fracturing to lateral fractures 208 in FIG. 2 can create outwardly extending fractures, including mini-fractures, when triggered, such as for example lateral extension fractures 210 and transverse fractures 212 in FIG. 2. Exothermic reaction components containing an ammonium ion and nitrite ion for example have been shown to be suitable for creating fractures in tight formations.

Disclosed systems and methods enhance productivity of tight gas wells, for example, by increasing stimulated reservoir volume beyond currently existing fracturing and completion methods.

With concentric coiled tubing, two fluids can be injected separately into a target lateral and then combined, for example an ammonium ion containing fluid and a nitrite ion containing fluid, to provide control over the placement of and reaction of exothermic chemicals in a particular lateral. In some embodiments, a single exothermic reaction component can be introduced with encapsulated chemicals, such that the chemicals do not react to produce heat and pressure until they are proximate the sand face in a given lateral.

Maximizing reservoir contact with multilaterals and stimulating them with at least one exothermic reaction component in addition to slickwater provides a greater stimulating effect over existing multistage fracturing methods performed in horizontal wells. Underbalanced coiled tubing drilling (UBCTD) in multilateral openhole completion wells aids in reducing and eliminating damage caused to formations by overbalanced drilling.

In some embodiments, exothermic chemicals are pumped downhole after all the multilaterals have been drilled and completed using UBCTD. In other embodiments, certain amounts of exothermic chemicals are pumped downhole during UBCTD of multilaterals. In some embodiments, exothermic chemicals are pumped into the toe of each drilled lateral using a concentric coiled tubing that will pump each of the chemicals alone or separately, such that they meet and react once they reach the formation. Concentric coiled tubing is a type of coiled tubing with a pipe inside the coil tubing pipe to enable the application of exothermic chemical injection into the zone of interest in a particular lateral drilled in a multilateral well drilled using UBCTD.

Injection of exothermic chemicals into the toe of a lateral and moving the concentric coil tubing out of the lateral towards the heel of the lateral while the exothermic chemicals are being pumped provides a unique method of stimulating a given lateral. The process can be repeated into another lateral until all laterals in a multilateral well have been treated and a multilateral fracture network is created, with a certain of permeability and connectivity between different multilaterals.

If a multilateral well drilled using UBCTD is drilled in an ultra-tight formation, the drilled and completed laterals can be hydraulically fractured using slickwater fluids, and the exothermic chemical may be included in the fracturing fluids to further create more micro fractures that will enhance the stimulation treatment.

Ultra-tight formations include those reservoir rocks where permeability can be as low as the nano-Darcy range making production of the hydrocarbons nearly impossible without a large stimulation treatment.

The exothermic reaction component can include one or more redox reactants that exothermically react to produce heat and increase pressure. The exothermic reaction components do not combust, but release heat, gas, and pressure during a triggered or activated redox reaction. Exothermic reaction components include urea, sodium hypochlorite, ammonium containing compounds, and nitrite containing compounds. In at least one embodiment, the exothermic reaction component includes ammonium containing compounds. Ammonium containing compounds include ammonium chloride, ammonium bromide, ammonium nitrate, ammonium sulfate, ammonium carbonate, and ammonium hydroxide. In at least one embodiment, the exothermic reaction component includes nitrite containing compounds. Nitrite containing compounds include sodium nitrite and potassium nitrite. In at least one embodiment, the exothermic reaction component includes both ammonium containing compounds and nitrite containing compounds. In at least one embodiment, the ammonium containing compound is ammonium chloride, $NH_4Cl$. In at least one embodiment, the nitrite containing compound is sodium nitrite, $NaNO_2$.

In at least one embodiment, the exothermic reaction component includes two redox reactants: $NH_4Cl$ and $NaNO_2$, which react according to Equation 1:

$$NH_4Cl + NaNO_2 \xrightarrow{(H^+ \text{ and/or } \Delta H \text{ and/or microwaves})} N_2 + NaCl + 2H_2O + \text{Heat}$$

Equation 1

In a reaction of the exothermic reaction components according to the above equation, generated gas can contribute to a reduction of viscosity of residual viscous materials in the fractures of a formation possibly left behind from well fracturing operations (for example guar), and the heat and gas generated can also reduce the viscosity of viscous hydrocarbons, such as for example asphaltenes, further increasing hydrocarbon recovery. Concentrations of exothermic reaction components in a solution can be between about 1 M and about 9 M, in some embodiments. For example, an exothermic reaction component can include a 3M $NH_4Cl$ and 3M $NaNO_2$ aqueous solution. The molar ratio of components can vary between about 1:1 and about 1:9. The volume amount of exothermic reaction component solution added to slickwater can vary between about 1 V % and about 50 V %, or between about 5 V % and about 40 V %, or between about 10 V % and about 30 V %, or between about 15 V % and about 25 V %.

The exothermic reaction component is triggered to react. In at least one embodiment, the exothermic reaction component is triggered within the laterals in addition to or alternative to triggered in pre-existing fractures. In at least one embodiment of the present disclosure, an acid precursor triggers the exothermic reaction component to react by releasing hydrogen ions, and in some embodiments the acid precursor is completely consumed by the exothermic reaction such that no residual acid remains to damage the formation or the well.

In at least one embodiment, the exothermic reaction component is triggered by heat. The wellbore temperature and temperature of laterals can be reduced during a pre-pad injection or a pre-flush with brine and reach a temperature below 120° F. (48.9° C.). A slickwater fracturing fluid of the present disclosure can then be injected into the well and the wellbore temperature increases from the heat of the formation. When the wellbore and lateral temperatures reach a temperature greater than or equal to about 120° F., for example, depending on the composition of the exothermic reaction component, the reaction of redox reactants is triggered. In at least one embodiment of the present disclosure, the reaction of the redox reactants is triggered by temperature in the absence of the acid precursor. In at least one embodiment of the present disclosure, the exothermic reaction component is triggered by heat when the exothermic reaction component is within multi-branched laterals, optionally proximate pre-existing fractures.

In at least one embodiment, the exothermic reaction component is triggered by pH. A base can be added to an exothermic reaction component of the present disclosure to adjust the pH to between about 9 to about 12. In at least one embodiment the base is potassium hydroxide. The exothermic reaction component, optionally along with other components such as slickwater fracturing fluid, with the base is injected into the formation. Following the injection of the fracturing fluid, an acid is injected to adjust the pH to below about 6. When the pH is below about 6, the reaction of the redox reactants is triggered. In at least one embodiment of the present disclosure, the exothermic reaction component is triggered by pH when the exothermic reaction component is within the fractures.

Dual-string coiled tubing can be used to introduce the exothermic reaction component and the acid precursor to the wellbore and the laterals. In at least one embodiment, the exothermic reaction component includes $NH_4Cl$ and $NaNO_2$. The acid precursor can include acetic acid in addition to or alternative to HCl. In some embodiments, the acetic acid is mixed with $NH_4Cl$ and is injected in parallel with the $NaNO_2$, using different sides of the dual-string coiled tubing. The exothermic reaction component and the acid precursor mix within the multilaterals.

In an alternate embodiment of the present disclosure, a method to increase a stimulated reservoir volume in a gas-containing formation is provided. The gas-containing formation can include a tight gas formation, an unconventional gas formation, and a shale gas formation. The stimulated reservoir volume is the volume surrounding a wellbore in a reservoir that has been fractured to increase well production. Stimulated reservoir volume is a concept useful to describe the volume of a fracture network. The method to increase a stimulated reservoir volume can be performed regardless of the reservoir pressure in the gas-containing formation. The method to increase a stimulated reservoir volume can be performed in a gas-containing formation having a reservoir pressure in a range of atmospheric pressure to 10,000 psig.

In methods of the present disclosure, the exothermic reaction component is mixed to achieve a pre-selected solution pH. The pre-selected solution pH is in a range of about 6 to about 9.5, alternately about 6.5 to about 9. In at least one embodiment, the pre-selected solution pH is 6.5. The exothermic reaction component can be mixed with a slickwater fracturing fluid, a viscous fluid component, and/or a proppant component to form a fracturing fluid. The fracturing fluid is injected into the wellbore in the gas-containing formation to create fractures and a proppant(s) holds open the fractures.

The exothermic reaction component reacts, and upon reaction generates an optional pressure pulse that creates auxiliary fractures. Fracturing fluid can be used in a primary operation to create fractures extending from multilaterals. Auxiliary fractures or mini-fractures can extend from larger fractures caused by the fracturing fluid, and all of these types of fractures extending from multilaterals at varying depths create a multilateral fracture network. The multilateral fracture network increases stimulated reservoir volume. In some embodiments, injection of a hydraulic fracturing fluid including a viscous fluid component in addition to or alternative to a proppant component in addition to or alternative to an overflush component in addition to or alternative to an exothermic reaction component does not generate foam or introduce foam into the hydraulic formation including the hydraulic fractures and multilaterals.

In at least one embodiment, the exothermic reaction component reacts when the exothermic reaction component reaches the wellbore temperature or the formation temperature. The wellbore temperature or formation temperature can be between about 100° F. and about 250° F., alternately between about 120° F. and about 250° F., alternately between about 120° F. and about 230° F., alternately between about 140° F. and about 210° F., alternately about 160° F. and about 190° F. In at least one embodiment, the wellbore temperature is about 200° F. In at least one embodiment, the wellbore temperature at which the exothermic reaction component reacts is affected by the pre-selected solution pH and an initial pressure. The initial pressure is the pressure of the exothermic reaction component just prior to the reaction of the exothermic reaction component. Increased initial pressure can increase the wellbore temperature that triggers the reaction of the exothermic reaction component. Increased pre-selected solution pH can also increase the wellbore temperature that triggers the reaction of the exothermic reaction component.

When the exothermic reaction component reacts, the reaction can generate a pressure pulse and heat, in a non-combustive reaction. The pressure pulse is generated within milliseconds from the start of the reaction. The pressure pulse is at a pressure between about 500 psi and about 50,000 psi, alternately between about 500 psi and about 20,000 psi, alternately between about 500 psi and about 15,000 psi, alternately between about 1,000 psi and about 10,000 psi, alternately between about 1,000 psi and about 5,000 psi, and alternately between about 5,000 psi and about 10,000 psi.

The pressure pulse creates fractures, including for example mini-fractures extending outwardly from and in between multilaterals. Fractures can extend from the point of reaction in all directions without causing damage to the wellbore or to multilaterals. The pressure pulse creates the auxiliary fractures regardless of the reservoir pressure. The pressure of the pressure pulse is affected by the initial reservoir pressure, the concentration of the exothermic reaction component, and the solution volume. In addition to the pressure pulse, the reaction of the exothermic reaction component releases heat. The heat released by the reaction causes a sharp increase in the temperature of the formation, which causes thermal fracturing. Thus, the heat released by the exothermic reaction component contributes to the creation of the auxiliary fractures. The exothermic reaction component allows for a high degree of customization to meet the demands of the formation and fracturing conditions.

In at least one embodiment, the acid precursor can be used to trigger the exothermic reaction component to react. In at least one embodiment, the exothermic reaction component is injected into the wellbore in the absence of a viscous fluid component and a proppant component and allowed to react to generate the pressure pulse.

In at least one embodiment, the method to increase a stimulated reservoir volume also performs the method to clean up a viscous material, for example asphaltenes, or a residual viscous material, for example guar. The method of the present disclosure can be adjusted to meet the needs of the fracturing operation. In one embodiment, a fracturing fluid includes an exothermic reaction component that reacts to both create auxiliary fractures and to cleanup residual viscous material from the fracturing fluid. In one embodiment of the present disclosure, a fracturing fluid includes an exothermic reaction component that reacts to only create auxiliary fractures. In one embodiment, a fracturing fluid includes an exothermic reaction component that reacts to only cleanup residual viscous material.

A method to increase the stimulated reservoir volume of a hydrocarbon-containing, for example gas-containing, formation is described herein. The method to increase a stimulated reservoir volume can be performed in oil-containing formations, water-containing formations, or any other formation. In at least one embodiment of the present disclosure, the method to increase a stimulated reservoir volume can be performed to create fractures and auxiliary fractures in cement. In some embodiments, microwaves can be applied in situ to aid in triggering an exothermic reaction component by lowering the activation energy of the exothermic reaction without substantially affecting the temperature of the exothermic reaction component.

An acid precursor can include any acid that releases hydrogen ions to trigger the reaction of the exothermic reaction component. Acid precursors include triacetin (1,2,3-triacetoxypropane), methyl acetate, HCl, and acetic acid. In at least one embodiment, the acid precursor is triacetin. In at least one embodiment of the present disclosure, the acid precursor is acetic acid.

Although the disclosure has been described with respect to certain features, it should be understood that the features and embodiments of the features can be combined with other features and embodiments of those features.

Although the disclosure has been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a," "an," and "the" include plural referents, unless the context clearly dictates otherwise. The term "about" in some embodiments includes values 5% above or below the value or range of values provided.

As used throughout the disclosure and in the appended claims, the words "comprise," "has," and "include" and all grammatical variations thereof are each intended to have an open, non-limiting meaning that does not exclude additional elements or steps.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

While the disclosure has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present disclosure may suitably comprise, consist or consist essentially of the elements disclosed and may be practiced in the absence of an element not disclosed.

That claimed is:

1. A method of increasing a stimulated reservoir volume in a hydrocarbon-bearing formation in fluid communication with a wellbore, the method comprising the steps of:

drilling a plurality of lateral extensions at varying depths in the formation extending from a vertical wellbore using slickwater hydraulic fracturing fluid, the slickwater hydraulic fracturing fluid comprising at least one friction reducer; and injecting an exothermic reaction component into the plurality of lateral extensions to create a plurality of fractures extending outwardly from and between the plurality of lateral extensions to create a multilateral fracture network, wherein injection of the exothermic reaction component reduces required application of proppant by between about 100 lbs. and about 10,000 lbs. of proppant.

2. The method of claim 1, where the steps of drilling and injecting are carried out simultaneously.

3. The method of claim 1, where the step of injecting is carried out after the step of drilling.

4. The method of claim 1, the method further including the use of concentric coiled tubing operable to inject components of the exothermic reaction component separately where the exothermic reaction component reacts to produce pressure and heat once disposed in a lateral extension of the plurality of lateral extensions.

5. The method of claim 1, further comprising the steps of:

mixing the exothermic reaction component in an aqueous solution to achieve a pre-selected solution pH, wherein the exothermic reaction component is operable to react at a pre-selected reservoir temperature to generate a pressure pulse;

injecting the fracturing fluid into the wellbore in the hydrocarbon-bearing formation; and generating a pressure pulse when the exothermic reaction component reaches the pre-selected reservoir temperature, where the pressure pulse is operable to create at least a portion of the plurality of fractures.

6. The method of claim 1, wherein the exothermic reaction component comprises an ammonium containing compound and a nitrite containing compound.

7. The method of claim 6, wherein the ammonium containing compound comprises $NH_4Cl$ and the nitrite containing compound comprises $NaNO_2$.

8. The method of claim 5, wherein the pre-selected solution pH is between 5.7 and 9.

9. The method of claim 5, wherein the reservoir temperature is in a range between 48.8° C. (120° F.) and 121.1° C. (250° F.).

10. The method of claim 5, wherein the pressure pulse is between 500 psi and 50,000 psi.

11. The method of claim 5, wherein the pressure pulse creates fractures in less than 10 seconds.

12. The method of claim 5, wherein the pressure pulse creates fractures in less than 5 seconds.

13. The method of claim 1, wherein the slickwater hydraulic fracturing fluid further comprises at least one component selected from the group consisting of: a biocide, a surfactant, and a scale inhibitor.

14. The method of claim 1, wherein mixing the exothermic reaction component with the slickwater hydraulic fracturing fluid causes a less than 20% change to an original viscosity of the slickwater hydraulic fracturing fluid.

15. The method of claim 1, wherein mixing the exothermic reaction component with the slickwater hydraulic fracturing fluid causes a less than 10% change to an original viscosity of the slickwater hydraulic fracturing fluid.

16. The method of claim 1, wherein the exothermic reaction component is injected at between about 1 volume % and about 50 volume % of total fluids injected during the steps of drilling and injecting.

17. The method of claim 1, wherein the exothermic reaction component is injected at between about 10 volume % and about 30 volume % of total fluids injected during the steps of drilling and injecting.

18. The method of claim 1, wherein the steps of drilling and injecting are each repeated at least twice and are carried out alternatingly.

19. The method of claim 1, wherein the exothermic reaction component causes a non-combustive redox reaction to release heat and gas to create at least a portion of the plurality of fractures.

20. A hydraulic fracturing fluid composition comprising:

slickwater hydraulic fracturing fluid, wherein the slickwater hydraulic fracturing fluid comprises at least one friction reducer, and an aqueous exothermic reaction component composition, wherein the aqueous exothermic reaction component composition comprises between about 1 volume % and about 50 volume % of the hydraulic fracturing fluid composition and changes an initial viscosity of the slickwater hydraulic fracturing fluid by less than about 20%, and wherein the aqueous exothermic reaction component composition has a pre-determined initial pH to react in situ in a hydrocarbon bearing formation proximate a formation temperature to release heat and gas through a non-combustive redox reaction for creating a plurality of fractures in the hydrocarbon bearing formation, wherein the aqueous exothermic reaction component reduces required application of proppant by between about 100 lbs. and about 10,000 lbs. of proppant in the hydraulic fracturing fluid.

21. The composition of claim 20, wherein the aqueous exothermic reaction component composition changes an initial viscosity of the slickwater hydraulic fracturing fluid by less than about 10%.

22. The composition of claim 20, wherein the exothermic reaction component comprises an ammonium containing compound and a nitrite containing compound in a molar ratio between about 9:1 to 1:9.

23. The composition of claim 20, wherein the ammonium containing compound comprises $NH_4Cl$ and the nitrite containing compound comprises $NaNO_2$.

24. The composition of claim 20, wherein the pre-determined initial pH is between 5.7 and 9.

25. The composition of claim 20, wherein the slickwater hydraulic fracturing fluid further comprises at least one component selected from the group consisting of: a biocide, a surfactant, and a scale inhibitor.

26. The composition of claim 20, further comprising a hydroxide compound to modify pH of the hydraulic fracturing fluid composition.

27. The composition of claim 20, wherein the at least one friction reducer comprises polyacrylamide.

* * * * *